US007363975B2

(12) United States Patent
Loughlin

(10) Patent No.: US 7,363,975 B2
(45) Date of Patent: Apr. 29, 2008

(54) PUSH/PULL BELLEVILLE STACK FOR USE WITH ZERTECH MTM SEAL

(75) Inventor: Michael J. Loughlin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/713,336

(22) Filed: Mar. 2, 2007

(65) Prior Publication Data

US 2007/0235191 A1 Oct. 11, 2007

(51) Int. Cl.
*E21B 33/00* (2006.01)

(52) U.S. Cl. ..... 166/285; 166/179

(58) Field of Classification Search ..... None
See application file for complete search history.

(56) References Cited

U.S. PATENT DOCUMENTS 4,049,055 A * 9/1977 Brown ..... 166/278
4,561,499 A * 12/1985 Berner et al. ..... 166/341
6,896,049 B2 5/2005 Moyes
7,134,506 B2 * 11/2006 Moyes ..... 166/387

* cited by examiner

*Primary Examiner*—Frank Tsay
(74) *Attorney, Agent, or Firm*—Cantor Colburn LLP

(57) ABSTRACT

A settable and unsettable seal arrangement includes a metal-to-metal seal element; a setting/releasing sleeve in operable communication with the seal element; a retraction ring fixedly attached to the setting/releasing sleeve; a load preservation and unsetting sleeve fixedly attached to the seal element; and a resilient member operably disposed between the setting/releasing sleeve and the load preservation and unsetting sleeve and method for setting and unsetting.

12 Claims, 1 Drawing Sheet

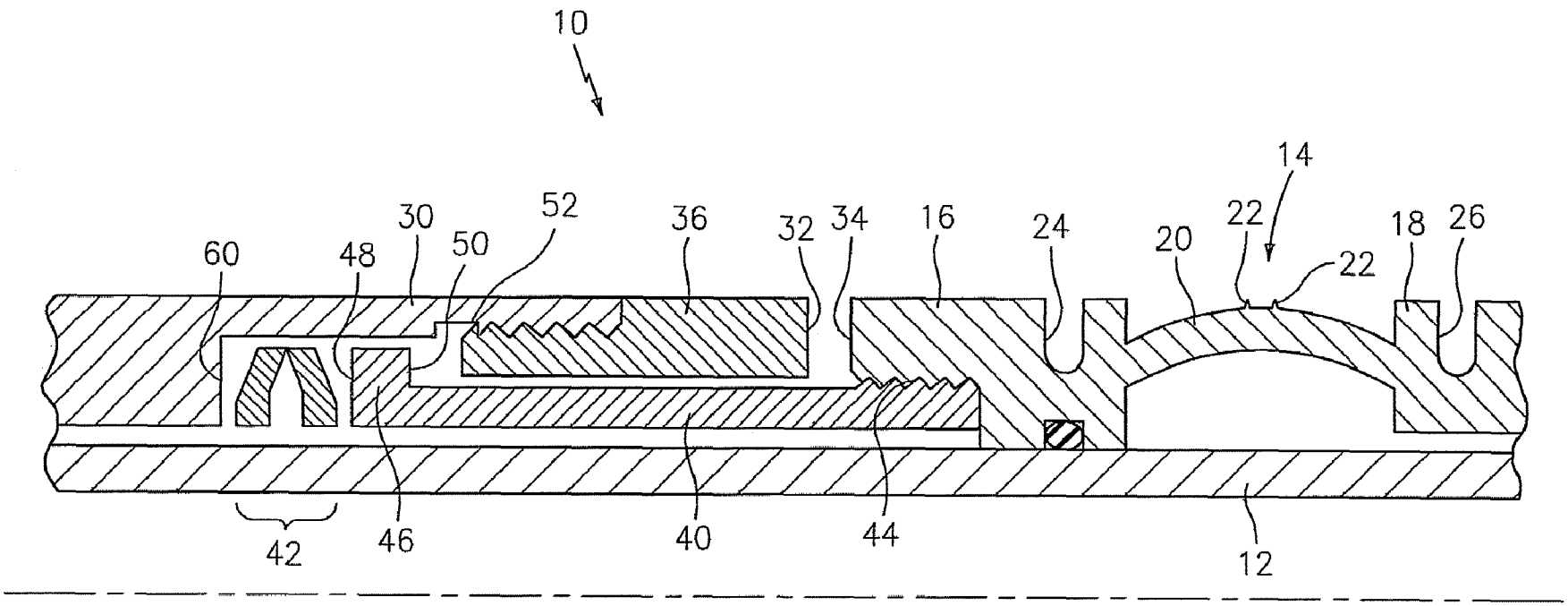
10
14
12
16
18
20
22
22
24
26
30
32
34
36
40
42
44
46
48
50
52
60

PUSH/PULL BELLEVILLE STACK FOR USE WITH ZERTECH MTM SEAL

CROSS-REFERENCE TO RELATED APPLICATIONS

This application claims priority to U.S. application Ser. No. 11/544,259, filed Oct. 6, 2006, which is a continuation patent application of U.S. patent application Ser. No. 11/114,488, filed Apr. 26, 2005, which is a divisional patent application of U.S. patent Ser. No. 10/336,848 filed Jan. 6, 2003, now U.S. Pat. No. 6,896,049, which is a continuation under 35 USC 120 of PCT/GB01/03072, filed Jul. 9, 2001, which published in English as WO 02/04783 and corresponds to British Patent Application GB 0016595.1, filed Jul. 7, 2000, the entire content of each of which is incorporated herein by reference.

BACKGROUND OF THE INVENTION

In downhole industries, including the hydrocarbon production industry, settable seals are a commonly used device. Settable seals, in some configurations are used to create an annular seal, and in some applications, also serve a mechanical centering or anchoring function, between nested tubular members. While traditional elastomeric annular seals are quite effective for their intended purpose, the do suffer from degradation due to the harsh environment downhole. When annular seals fail, they usually require replacement. Replacement causes interruption in production and significant rig time both translating into a substantial cost. Since costs are always to be avoided in any business venture, the art would well receive a settable seal having greater resistance to the downhole environment thereby creating a longer service life.

SUMMARY

A settable and unsettable seal arrangement includes a metal-to-metal seal element; a setting/releasing sleeve in operable communication with the seal element; a retraction ring fixedly attached to the setting/releasing sleeve; a load preservation and unsetting sleeve fixedly attached to the seal element; and a resilient member operably disposed between the setting/releasing sleeve and the load preservation and unsetting sleeve.

A method for setting and maintaining a compressive load on a metal-to-metal seal element includes urging a setting/releasing sleeve in a direction to axially compress a metal-to-metal seal element; compressing a resilient member during the urging; and retaining the setting/releasing sleeve in an actuated position.

BRIEF DESCRIPTION OF THE DRAWINGS

Referring now to the drawings wherein like elements are numbered alike in the several Figures:

FIG. 1 is a schematic cross section view of a settable and unsettable seal arrangement of the invention.

DETAILED DESCRIPTION OF THE DRAWINGS

Referring to FIG. 1, a settable and unsettable seal arrangement 10 is illustrated. The seal arrangement includes a mandrel 12 about which is disposed a metal-to-metal seal element 14 such as that disclosed in U.S. Pat. No. 6,896,049 to Moyes, which is incorporated herein by reference in its entirety. The seal element 14 comprises two end housings 16 and 18 and a bulbous seal member 20. Upon the seal member 20 in one embodiment is a pair of pips 22 as shown. It will be appreciated that more or fewer pips could be utilized as desired. Seal member 20 is shaped to predispose it to deform in a specific direction (as illustrated, radially outwardly). To assist in this movement, recesses 24 and 26 are provided adjacent the seal member 20 as shown. Predisposed deformation is achieved by axially loading the seal element 14. It is to be understood that end housing 18 is supported against axial compression from the left side of the drawing so that upon such axial compressive load applied from the left side of the drawing, the end housing 18 stays in place. In this condition, the seal member 20 will deform outwardly into sealing engagement with a target tubular radially outwardly disposed thereof (not shown).

In the illustrated embodiment, seal element 14 is axially loaded and thereby actuated by a setting/releasing sleeve 30. Sleeve 30 includes an end surface 32 that remains spaced from end housing surface 34 thus ensuring that setting load from sleeve 30 is transferred to the seal element 14 through a resilient member 42 (which may comprise at least one to a plurality of resilient elements working together), rather than directly through the sleeve 30. The resilience of the system provides benefits in longevity and durability of the resulting seal. The setting force of sleeve 30 is imparted to the seal element 14 through a load surface 60 of sleeve 30 thereby compressing the resilient member 42. The compressive load is transferred through the resilient member 42 to a bias surface 48 of a load preservation and unsetting sleeve 40 and then to the seal 14. As configured the resilient member maintains the setting force on the seal member 14 while compensating for movement that might occur in the system. Sleeve 30 is actuable toward seal element 14 by any convenient actuation means such as hydraulic pressure, motor actuation, etc.

Sleeve 30 further optionally may include a retraction ring 36 if releasability is desired for the particular seal. In an embodiment, including the retraction ring 36, the ring may be threadably connected to the balance of sleeve 30 or may be integral therewith.

Addressing the actuating/retrieving components just introduced in greater detail, end housing 16 is undercut and threaded at 44 to allow threadedly fixed engagement with load preservation and unsetting sleeve 40. Further, the connection could be integrally formed if desired or otherwise mechanically attached. The sleeve 40 further includes a radially outwardly extending flange 46 that operably includes the bias surface 48, noted above, and an unset surface 50. The bias surface 48 is configured and positioned to interact with resilient member 42, causing sleeve 40 to be urged against seal 14 through thread 44. Such urging maintains a compressive load on seal 14 even after many thermal cycles of the surrounding environment. More specifically, resilient member 42, which in one embodiment as shown, is one or more spring washers, such as Belleville type washers, maintains the compressive force on seal 14 while at the same time compensation for any movement in the system thereby ensuring that the seal remains in proper operation. In general, as one of skill in the art will understand, because ratcheting devices such as body lock rings (not shown) have a finite number of supported positions, an actuating sleeve relying on one might move in a direction opposite that of actuation for a maximum distance of one tooth of the ratchet mechanism. Such movement, although small can have detrimental effect on the seal load applied radially against a target tubular by the seal 14 because the radially outward expansion of the seal 10 is dependent entirely upon the degree of axial compression thereof. When the axial compression is relieved, the radial expansion is reduced. When the radial expansion is reduced, the load for sealing is reduced. The resilient member 42 alleviates this problem by maintaining axial compressive load on the seal 14 even when the sleeve 30 moves slightly in a direction opposite the actuation direction to the extent of the spring constant of the resilient member 42.

Conversely, the sleeve 40, because of the flange 46 and the relative radial positioning of ring 36, is capable of facilitating unactuation and retraction of seal 14. Ring 36 includes sleeve contact face 52 that is positioned and configured to interact with unset surface 50 when sleeve 30 is purposefully moved in a direction opposite that of setting of the seal 14. The movement will first be taken up by resilient member 42 expanding but when face 52 and surface 50 make contact, a pull from sleeve 30 is directly transmitted to seal 14 to stretch it out axially, reducing its radial dimension and unsetting the same. Because of the construction of the seal 14, axial elongation both unsets the seal and reduces the radial dimension thereof to a position usually not in any contact with the target tubular.

A method for setting and maintaining a compressive load on a metal-to-metal seal element is also contemplated herein that includes urging the setting/releasing sleeve 30 in a direction calculated to axially compress the metal-to-metal seal element 14. During the urging of the sleeve 30 toward seal 14 the resilient member 42 is being compressed so that the axial load is transmitted therethrough to the seal 14. The method further includes unsetting the seal 14 by moving the load preservation and unsetting sleeve 40 in a direction opposite that of actuation. Such action places an axial tensile load on the metal-to-metal seal element, drawing the seal element to an unset position. Once unset, the seal element 14 is generally not in contact with the target tubular and can easily be moved without damage to the seal or drag on the target tubular.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A settable and unsettable seal arrangement comprising:

a metal-to-metal seal element;

a setting/releasing sleeve in operable communication with the seal element;

a retraction ring fixedly attached to the setting/releasing sleeve;

a load preservation and unsetting sleeve fixedly attached to the seal element; and a resilient member operably disposed at the setting/releasing sleeve and the load preservation and unsetting sleeve.

2. A settable and unsettable tool as claimed in claim 1 wherein the seal element includes a pair of end housings and a bulbous seal member.

3. A settable and unsettable tool as claimed in claim 1 wherein the seal element is radially expandable upon application of axial compressive load.

4. A settable and unsettable tool as claimed in claim 1 wherein the retraction ring is integrally formed with the setting/releasing sleeve.

5. A settable and unsettable tool as claimed in claim 1 wherein the retraction ring is mechanically fastened to the setting/releasing sleeve.

6. A settable and unsettable tool as claimed in claim 1 wherein the load preservation sleeve is integral with an end housing of the seal element.

7. A settable and unsettable tool as claimed in claim 1 wherein the resilient member comprises at least one resilient element.

8. A settable and unsettable tool as claimed in claim 1 wherein the resilient member comprises a plurality of resilient elements.

9. A settable and unsettable tool as claimed in claim 1 wherein the resilient member comprises at least one spring washer.

10. A settable and unsettable tool as claimed in claim 9 wherein the at least one spring washer is one or more spring washers.

11. A method for setting and maintaining a compressive load on a metal-to-metal seal element comprising:

urging a setting/releasing sleeve in a direction to axially compress a metal-to-metal seal element;

compressing a resilient member during the urging; and retaining the setting/releasing sleeve in an actuated position.

12. A method for setting and maintaining a compressive load as claimed in claim 11 wherein the method for setting further comprises a method for releasing a set metal-to-metal seal element including:

drawing the setting/releasing sleeve away from the metal-to-metal seal elements;

moving a load preservation and unsetting sleeve in a direction opposite that of actuation of the metal-to-metal seal element;

placing an axial tensile load on the metal-to-metal seal element; and drawing the seal element to an unset position.

* * * * *